US006116504A

United States Patent [19]

Ariga

[11] Patent Number: 6,116,504

[45] **Date of Patent: *Sep. 12, 2000**

[54] OPENING/CLOSING MECHANISM FOR DRAWER MEMBER

[75] Inventor: Isao Ariga, Kawasaki, Japan

[73] Assignee: Fujitsu Limited, Kawasaki, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/925,736

[22] Filed: Sep. 9, 1997

[30] Foreign Application Priority Data

Jan. 27, 1997 [JP] Japan ..... 9-012534

[51] Int. Cl.[7] ..... G07G 1/00

[52] U.S. Cl. ..... 235/22; 235/7 R

[58] Field of Search ..... 235/22, 7 R; 312/127, 312/129, 135.1, 215, 216, 217, 218, 219, 220, 221, 222

[56] References Cited

U.S. PATENT DOCUMENTS

| | | | |
|---|---|---|---|
| 568,764 | 10/1896 | Jacques et al. | 235/22 |
| 905,072 | 11/1908 | Heinitz | 235/22 |
| 1,175,862 | 3/1916 | Burnett | 235/22 |
| 4,441,767 | 4/1984 | Stark | 316/216 |

*Primary Examiner*—Karl D. Frech
*Attorney, Agent, or Firm*—Armstrong, Westerman, Hattori, McLeland & Naughton

[57] ABSTRACT

An opening/closing mechanism for a drawer member includes a stopper member for stopping movement of the drawer member, where the position of a stopper member is variable, in the direction of movement of the drawer member, so as to adjust the degree of opening of the drawer member. Rotatable rollers are preferably provided on one of the drawer member and a housing therefore, and a stopper member provided on the other, engagable with the rollers for stopping movement of the drawer. The stopper member enables resumption of movement of the of the drawer after being stopped by the stopper member. If desired, a plurality of stopper members may be provided.

15 Claims, 10 Drawing Sheets

PRIORT ART

PRIORT ART

OPENING/CLOSING MECHANISM FOR DRAWER MEMBER

BACKGROUND OF THE INVENTION

The present invention generally relates to an opening/closing mechanism for a drawer member, and particularly, to an opening/closing mechanism which enables a multiple-level opening/closing operation of the drawer member.

The opening/closing mechanism according to the present invention may be applied to, for example, a drawer of a register provided at a cashier counter. Hereinafter, although the present invention will be explained using a drawer of a register, it is understood that the present invention is also applicable to various opening/closing members.

Recently, control of commodities using a register terminal such as a point-of-sale (POS) terminal has become widespread among many kinds of retail stores. A drawer unit which is used to accommodate money from customers is provided at the register terminal. In the drawer unit, a drawer member is provided and tray portions for putting the money (i.e., bills and coins) in order are provided in the drawer member. The drawer member (hereinafter also referred to as a drawer) of the drawer unit is usually closed (i.e., positioned in the drawer unit) and is opened when the money is taken out or put therein.

If the opening degree of the drawer (i.e., the distance of the front end of the drawer between the closed state and the opened state thereof) is made constant, it is not necessary for an operator to make any unnecessary movement to avoid the drawer, and hence workload of the operator may be reduced.

FIG. 1 is a diagram showing a perspective view of a conventional drawer unit. In FIG. 1, some portions of the drawer unit, which are hidden by the other portions, are indicated by the dotted lines. FIG. 2A is a diagram showing a top view of the drawer unit in which the drawer is closed. FIG. 2B is a diagram showing a top view of the drawer unit in which the drawer is opened. In FIGS. 2A and 2B, also, some portions of the drawer unit, which are hidden by the other portions, are indicated by the dotted lines.

As shown in the above figures, the drawer may be contained in a housing of the drawer unit and tray portions are provided in the drawer. A roller is provided at the right-hand side and the left-hand side, respectively, of the back of the drawer. Each of the rollers is rotatably supported by an end portion of an arm member. A spring is provided with the other end of the arm member so that the arm member is pulled by a force exerted by the spring.

A rail is provided inside of the housing at the right-hand side and the left-hand side. The afore-mentioned rollers, respectively, contact the rail by the force exerted by the corresponding spring. In the opening state of the drawer, as shown in FIG. 2B, the rollers of the right-hand side and the left-hand side are pushed against a respective concave portion formed in the housing, and hence the movement of the drawer is stopped. It is possible to further open the drawer shown in FIG. 2B by pulling the drawer by hand.

However, the conventional drawer unit has at least the following problems.

In the conventional drawer unit, since no marks indicating the opening degree of the drawer are provided, there is a danger that the opening drawer may contact an operator. Especially, some drawer units employ strong springs and when such drawer units are used, the operator may be hit or injured by the opening drawer which is strongly accelerated by the force of the springs.

Also, the opening degree of the drawer of the drawer unit shown in FIGS. 1 and 2 is set to be constant and the opening degree cannot be changed easily. However, under some circumstances, a shop or a store that owns the drawer unit wishes to change freely the opening degree of the drawer depending on, for instance, the space available for the drawer unit.

Moreover, it is usual that the bills are stored in the back portions of the drawer. However, if the drawer is fully-opened, the bills in the drawer may be seen by a third party and a crime may be induced. Hence, it is desirable that the opening degree of the drawer to be small from a crime-prevention point of view.

On the other hand, if the opening degree of the drawer is too small, it is necessary to pull the drawer further, after movement of the drawer is once stopped, by using one's hands. Thus, a store or shop which deals with a large amount of money may wish to increase the opening degree of the drawer so that the handling of money may become easier.

As mentioned above, if the opening degree of the drawer is set to be constant, it is difficult to satisfy various requests from a variety of shops.

SUMMARY OF THE INVENTION

Accordingly, it is a general object of this invention to provide an opening/closing mechanism for a drawer member in which the above-mentioned problems are eliminated.

A more specific object of the present invention is to provide an opening/closing mechanism for a drawer member by which an opening degree of the drawer member may be varied when necessary.

Another object of the present invention is to provide an opening/closing mechanism for a drawer by which a drawer unit that is capable of preventing bills in the drawer from being seen by a third party may be provided.

Yet another object of the present invention is to provide a drawer unit which can be most suitably set in accordance with, for instance, the space available for a register counter of a shop.

The objects described above are achieved by an opening/closing mechanism for a drawer member comprising: a stopper means for stopping movement of the drawer member, wherein a position of the stopper means is variable so as to adjust a degree of opening of the drawer member.

The objects described above are also achieved by the opening/closing mechanism, wherein the stopper means enables a resumption of the movement of the drawer member after the movement has been stopped by the stopper means.

The objects described above are also achieved by the opening/closing mechanism, wherein a plurality of the stopper means are provided.

According to the above opening/closing mechanism for a drawer member, since the opening degree of the drawer member may be adjusted, it becomes possible to achieve a desired opening degree of the drawer member in accordance with a condition of each store or shop. Also, the danger that the drawer member may contact or hit an operator when the drawer is opened can be eliminated. Moreover, it becomes possible to prevent bills in the drawer member from being seen by a third party.

Further, since the drawer member stopped by the stopper means may be further opened, it is possible to use the stopper means for attenuating the opening velocity of the drawer member. In addition, since a plurality of stopper means may be provided, a multiple-level opening/closing operation of the drawer member may be performed.

The objects described above are achieved by a drawer unit comprising: a drawer member, and a stopper means for stopping movement of the drawer member, wherein a position of the stopper means is variable so as to adjust a degree of opening of the drawer member.

The objects described above are also achieved by the drawer unit, wherein the stopper means enables a resumption of the movement of the drawer member after the movement has been stopped by the stopper means.

The objects described above are also achieved by the drawer unit, wherein a plurality of the stopper means are provided.

According to the above drawer unit, since the opening degree of the drawer member may be adjusted, it becomes possible to achieve a desired opening degree of the drawer member in accordance with a condition of each store or shop. Also, the danger that the drawer member may contact or hit an operator when the drawer is opened can be eliminated. Moreover, it becomes possible to prevent bills in the drawer member from being seen by a third party.

Further, since the drawer member stopped by the stopper means may be further opened, it is possible to use the stopper means for attenuating the opening velocity of the drawer member. In addition, since a plurality of stopper means may be provided, a multiple-level opening/closing operation of the drawer member may be performed.

The objects described above are achieved by an opening/closing mechanism for a drawer member which is accommodated in a housing member so as to be movable in back and forth directions comprising: a first guiding member provided with one of the drawer member and the housing member, and a second guiding member provided with another one of the drawer member and the housing member, wherein the first guiding member contacts the second guiding member when the drawer member has moved a certain distance thereby stopping movement of the drawer member, and a position of at least one of the first guiding member and the second guiding member is variable so as to adjust a degree of opening of the drawer member.

The objects described above are also achieved by the opening/closing mechanism, wherein each of the first guiding member and the second guiding member enables a resumption of the movement of the drawer member after the movement of the drawer member has been stopped by the first guiding member and the second guiding member.

The objects described above are also achieved by the opening/closing mechanism, wherein a plurality of one of the first guiding member and the second guiding member is provided.

According to the above opening/closing mechanism for a drawer member, since the opening degree of the drawer member may be adjusted, it becomes possible to achieve a desired opening degree of the drawer member in accordance with a condition of each store or shop. Also, the danger that the drawer member may contact or hit an operator when the drawer is opened can be eliminated. Moreover, it becomes possible to prevent bills in the drawer member from being seen by a third party.

Further, since the drawer member once stopped by the first guiding member and the second guiding member may be further opened, it is possible to use the first guiding means and the second guiding means for attenuating the opening velocity of the drawer member. In addition, since a plurality of one of the first guiding member and the second guiding member may be provided, a multiple-level opening/closing operation of the drawer member may be performed.

Other objects and further features of the present invention will be apparent from the following detailed description when read in conjunction with the accompanied drawings.

DESCRIPTION OF THE PREFERRED EMBODIMENTS

In the following, a principle and embodiments of the present invention will be described with reference to the accompanying drawings. As mentioned above, although the present invention will be explained using a drawer of a register as an example, the present invention is applicable not only to the drawer of the register but also any other suitable kind of opening/closing members.

Figure 1:
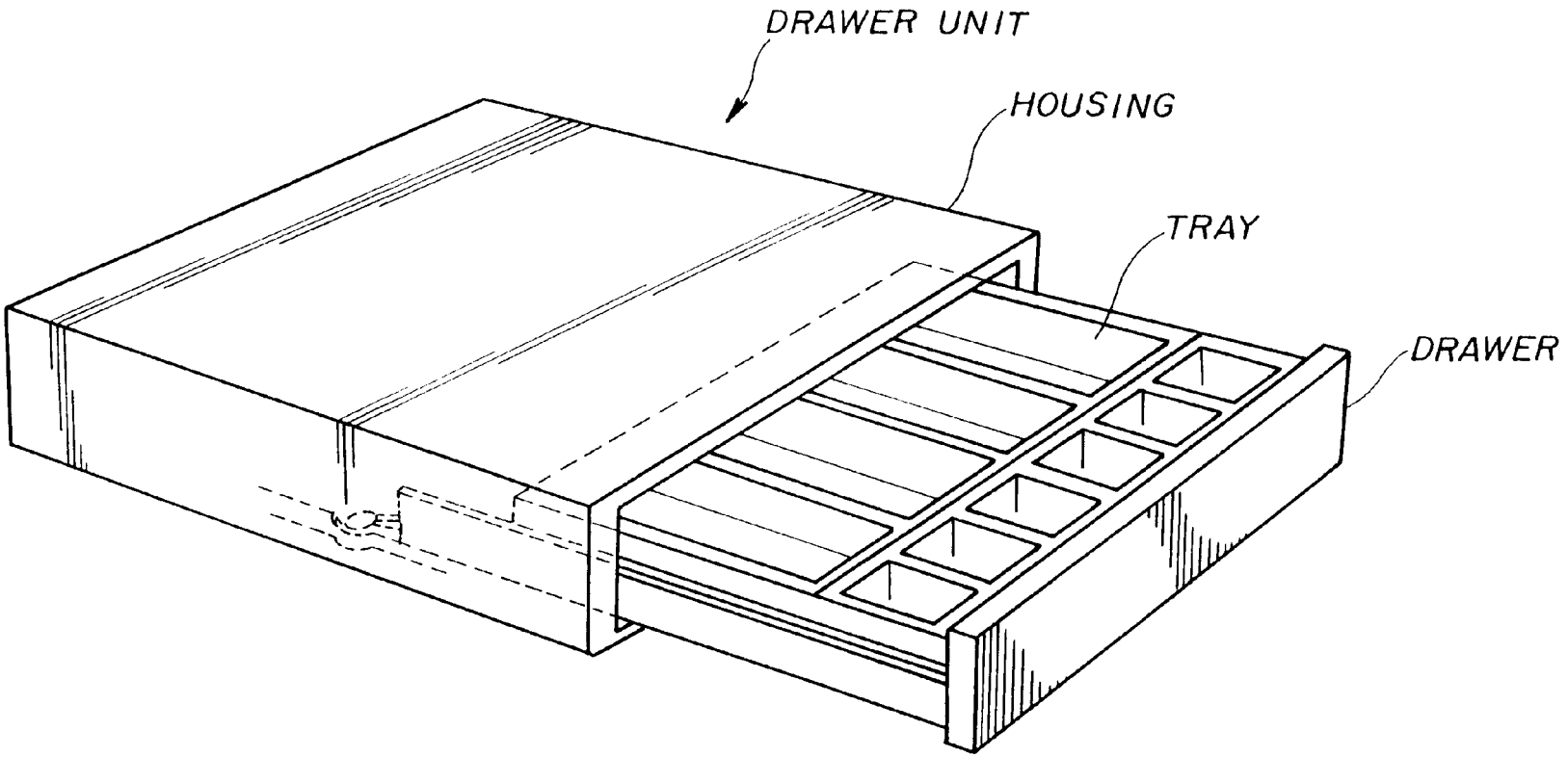
FIG. 1 PRIOR ART
FIG. 1 is a diagram showing a perspective view a conventional drawer unit.
Figure 2B:
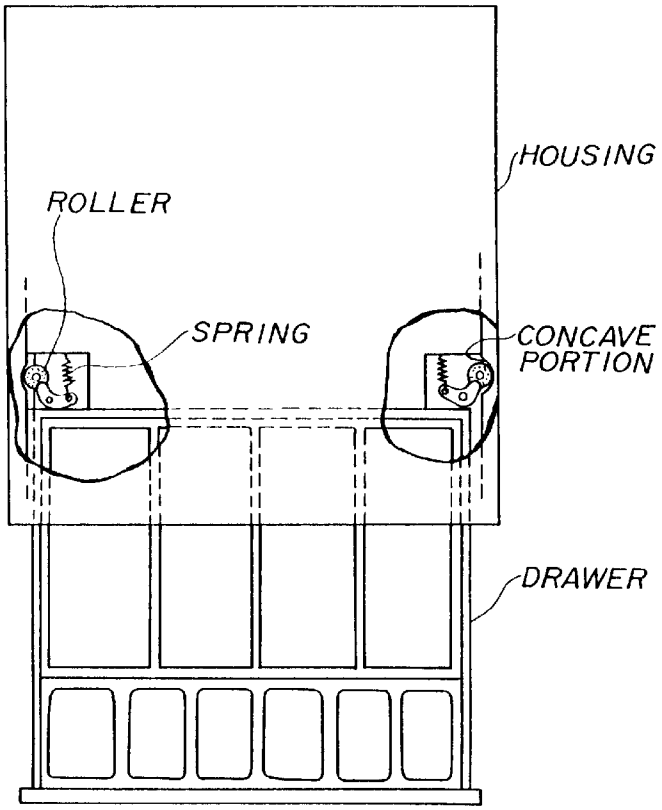
FIG. 2B is a top view of the conventional drawer unit in which the drawer is opened.
Figure 2A:
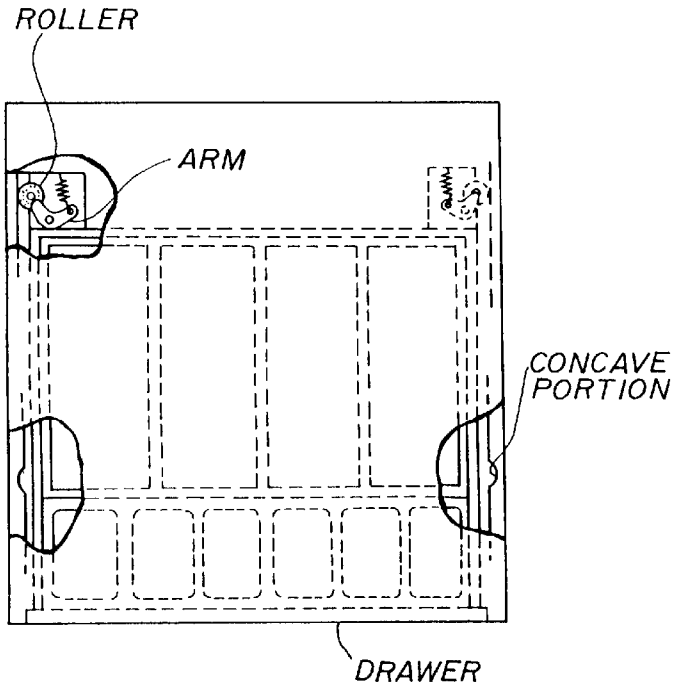
FIG. 2A is a top view of the conventional drawer unit in which the drawer is closed.
Figure 3:
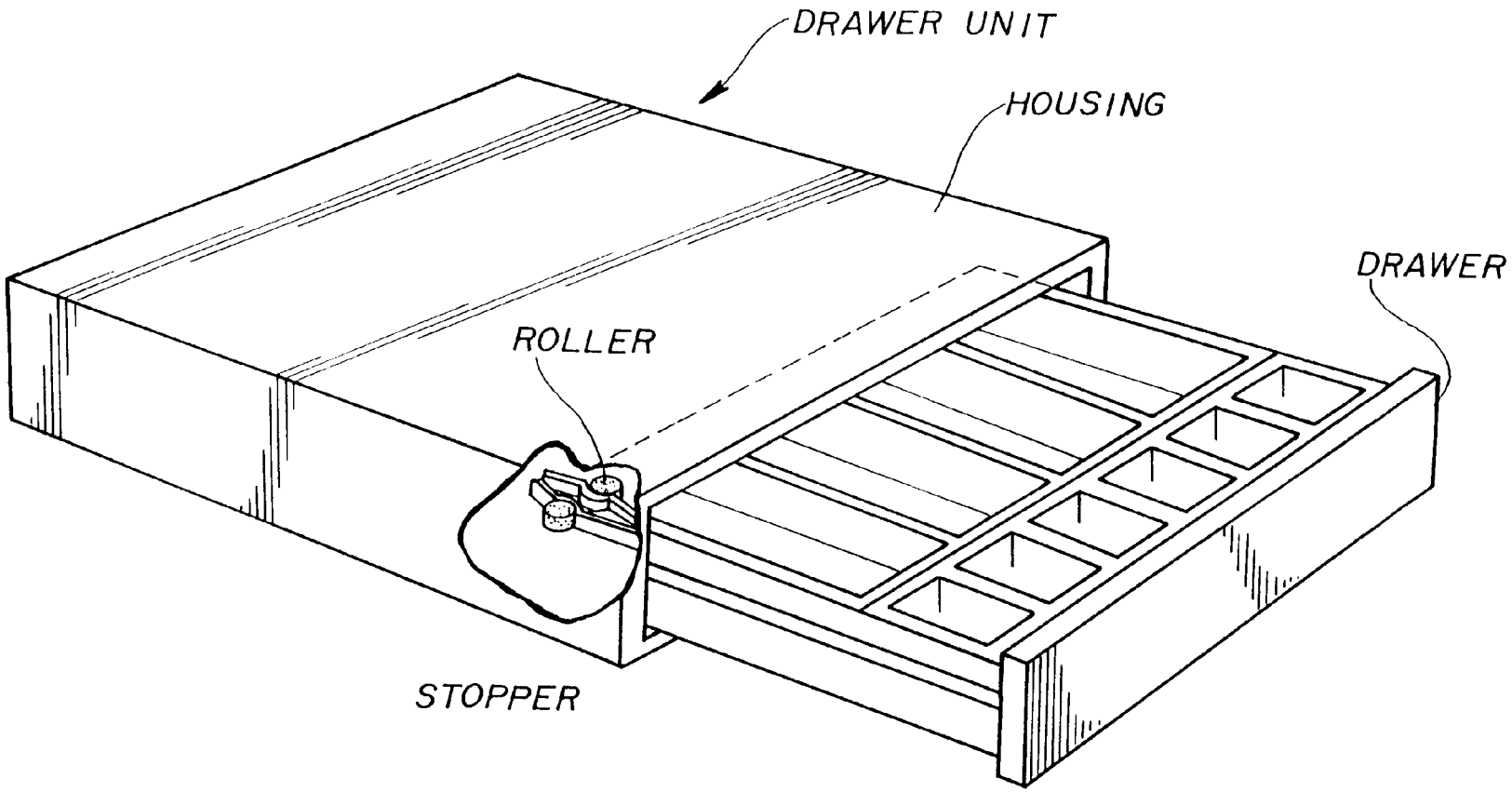
FIG. 3 is a diagram showing a perspective view of a drawer unit according to an embodiment of the present invention.
Figure 4B:
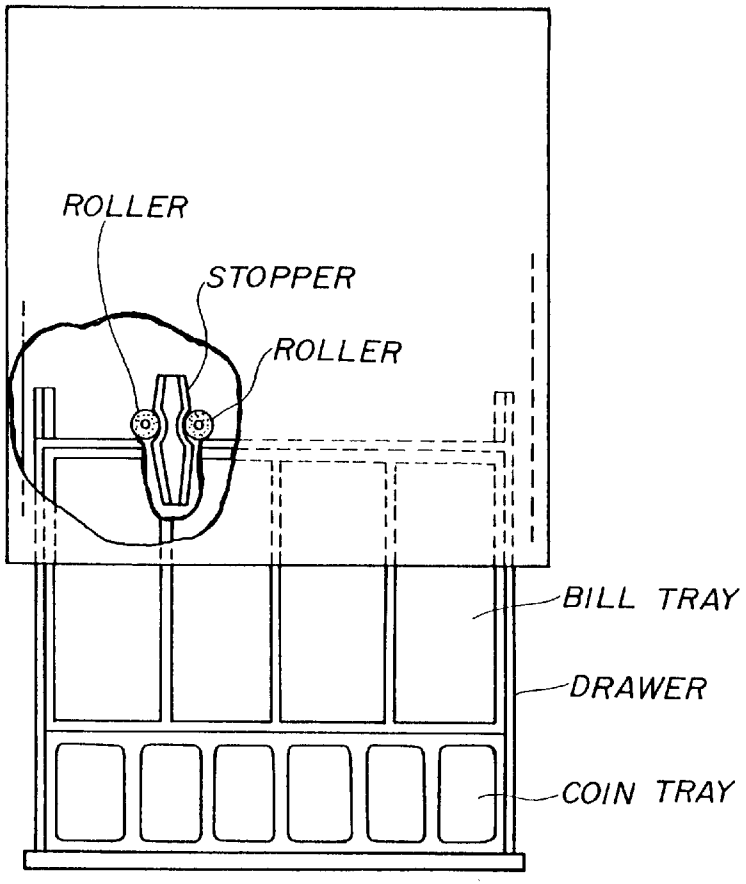
FIG. 4B is a diagram showing a top view of the drawer unit according to the present invention in which the drawer is opened.
Figure 4A:
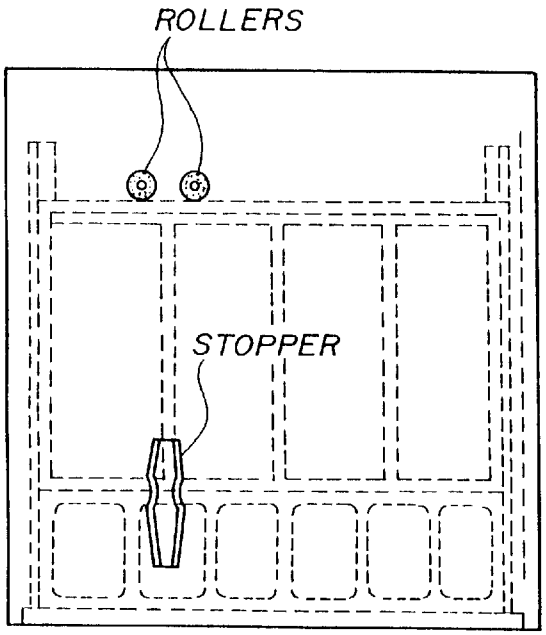
FIG. 4A is a diagram showing a top view of the drawer unit according to the present invention in which the drawer is closed.

FIG. 3 is a diagram showing a perspective view of a drawer unit according to an embodiment of the present invention. In FIG. 3, some portions of the drawer unit, which are hidden by the other portions thereof, are indicated by dotted lines. Also, in FIG. 3, rollers and a stopper provided inside the drawer unit are shown by omitting a part of the drawer. FIG. 4A is a diagram showing a top view of the drawer unit according to the present invention in which the drawer is closed. FIG. 4B is a diagram showing a top view of the drawer unit according to the present invention in which the drawer is opened. In FIGS. 4A and 4B, also, some portions of the drawer unit, which are hidden by the other portions, are indicated by the dotted lines, and the rollers and stoppers which are characteristics of the present invention are shown. FIGS. 4A and 4B also show the positional relationship between the stopper and the rollers.

The drawer unit according to the present invention is comprised of a drawer member (hereinafter also referred to as a drawer) and a housing in which the drawer is accommodated when the drawer is closed. Inside the drawer, tray portions for accommodating money are provided and the tray portions are divided into coin sections (coin trays) for accommodating coins and bill sections (bill trays) for accommodating bills. The coin trays may be located at the front portion of the drawer and the bill trays may be located at the back portion of the drawer as indicated in FIG. 4B.

Rails (not shown in the figure) are provided at the right-hand side and the left-hand side of the inside of the drawer unit. The drawer is guided by the rails when opened or closed. Also, the drawer is always pulled in the opening direction by elastic means (not shown) such as spring and the drawer is opened by the force exerted by such means.

As shown in FIGS. 4A and 4B, a pair of rollers is provided at the back of the drawer. Also, a stopper is provided on the lower surface of the housing. In the closing state of the drawer shown in FIG. 4A, the stopper is located underneath the drawer. The pair of rollers and the stopper are located so that they are aligned in the opening/closing directions of the drawer. In the opening state of the drawer, the pair of the rollers holds the stopper as shown in FIG. 4B.

Figure 5:
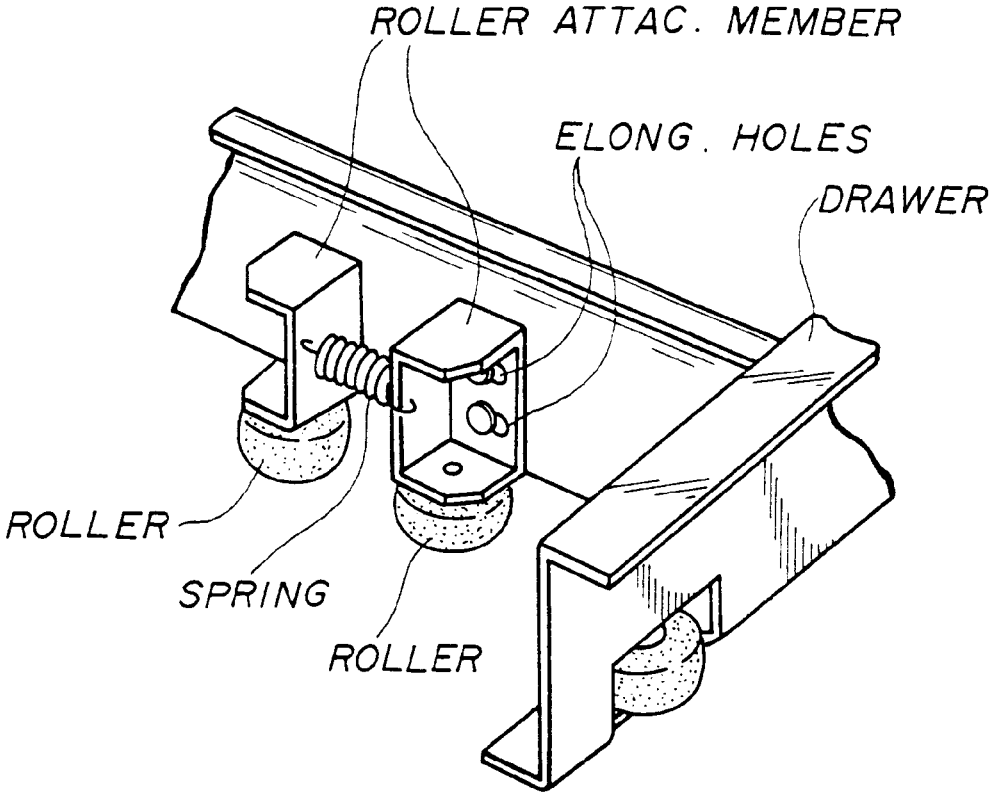
FIG. 5 is a diagram showing a structure of a pair of rollers provided at the back of the drawer.

FIG. 5 is a diagram showing a structure of the pair of rollers provided at the back of the drawer. As shown in the figure, roller attaching members for attaching the respective roller are provided at the back of the drawer. The roller attaching member may be formed of a metal plate.

A roller is rotatably attached to an end portion of the respective roller attaching member. A bearing is provided with the roller so that the roller may be rotated in a horizontal direction. Also, elongated holes extending in the horizontal direction are formed in the surface of the roller attaching member which contacts the back of the drawer. In FIG. 5, two elongated holes are shown, however, the number of the elongated holes are not limited. The roller attaching member is attached to the back of the drawer by, for instance, using screws penetrating the corresponding elongated hole. Note that the roller attaching member is not fixed to the drawer and may be moved in the right and the left directions in the figure. That is, the roller attaching member may be moved by a distance determined by the length of the elongated hole. Moreover, note that the elongated holes are also formed in the roller attaching member of the left-hand side of the figure, they are hidden by a surface of the roller attaching member.

A spring is provided between the right and the left roller attaching members. Due to the force exerted by the spring, the right and the left roller attaching members are pulled towards each other.

The rollers contact the rail formed in the housing and guide the opening/closing movement of the drawer.

Figure 6:
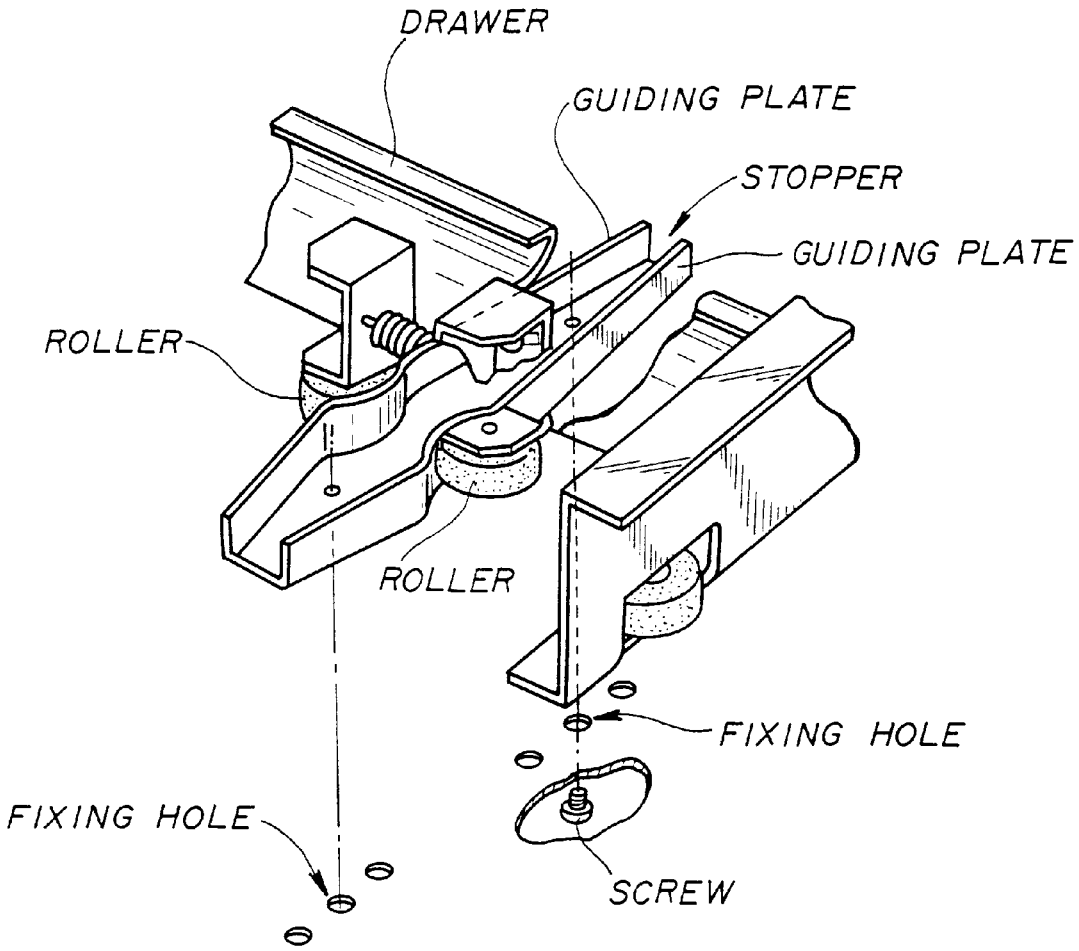
FIG. 6 is a diagram showing a state of a stopper being held by the right and the left rollers.

FIG. 6 is a diagram showing the stopper being held by the right and the left rollers. The state of the stopper and the rollers correspond to that shown in FIG. 4B. A guiding plate is formed on both sides of the stopper as shown in FIG. 6 and the width therebetween is widest in the vicinity of the central portion thereof and becomes narrower towards both ends. The rollers supported by the corresponding roller attaching member, which is provided at the back of the drawer, may contact the respective guiding plate of the stopper. A concave portion-having a shape which matches the shape of the roller is provided in the vicinity of a central portion of both of the guiding plates.

As mentioned above, when the drawer is opened, the drawer is pulled by the spring. When the rollers reach a position where the stopper is located, each of the rollers contacts the corresponding guiding plate of the stopper. Since the width between the guiding plates becomes wider towards the central portion of the stopper and the spring is employed for pulling the roller attaching members towards each other, the two rollers (or the two roller attaching members) gradually separated from each other as the rollers proceed towards the central portion of the stopper. Accordingly, the force applied to the drawer is gradually attenuated by the gradual movement of the rollers (i.e., the friction caused between the rollers and the stopper). Finally, when the rollers reach corresponding concave portions provided with the stopper, the rollers hold the concave portions of the stopper by the action of the spring provided between the right and left roller attaching members. Thus, the movement of the drawer is stopped.

Note that the drawer may be further opened from the state shown in FIG. 6 if the drawer is pulled by, for instance, the operator's hands. When the thus opened drawer is closed, since the width of the front end of the stopper (i.e., the width between the guiding plates at the front end of the stopper) is narrow, it is relatively easy to perform a closing operation of the drawer. That is, the stopper does not interfere with the closing operation of the drawer.

As shown in FIG. 6, screw holes (two in this embodiment) are formed in the bottom surface of the stopper and fixing holes are provided in the bottom surface of the housing. The stopper may be fixed to the bottom surface of the housing by, for instance, using screws via those holes.

Note that the reason that a plurality of fixing holes is provided in a row in the bottom surface of the housing is that the fixing position of the stopper may be changed when necessary. In the case shown in FIG. 6, the middle hole among the three fixing holes is used to fix the stopper. If the front hole is used, the position of the stopper may be shifted forwards and if the hole in the rear is employed, the position of the stopper is shifted backwards.

When the stopper is located at the back, the opening degree of the drawer is relatively small and when the stopper is located at the front, the opening degree of the drawer is relatively large.

The practical importance of the presence of the plurality of fixing holes is as follows.

In the opening state of the drawer shown in FIG. 4B, about a half of each of the bill trays is exposed to outside viewers. Thus, bills contained in the trays may be seen by many people and a crime may be induced. If a shop mainly deals with commodities which may be purchased by coins, it is not necessary that the bill trays of the drawer unit used in that shop be exposed. Thus, it is desirable that the opening degree of the drawer be adjustable according to a particular situation.

For the reason mentioned above, the stopper and the plurality of fixing holes as shown in FIG. 6 are provided in the embodiment according to the present invention. If the stopper is fixed using the fixing hole located at the back, the position of the stopper may be moved backward and hence the opening degree of the drawer may be reduced by a distance corresponding to the distance between the corresponding fixing holes.

Figure 7:
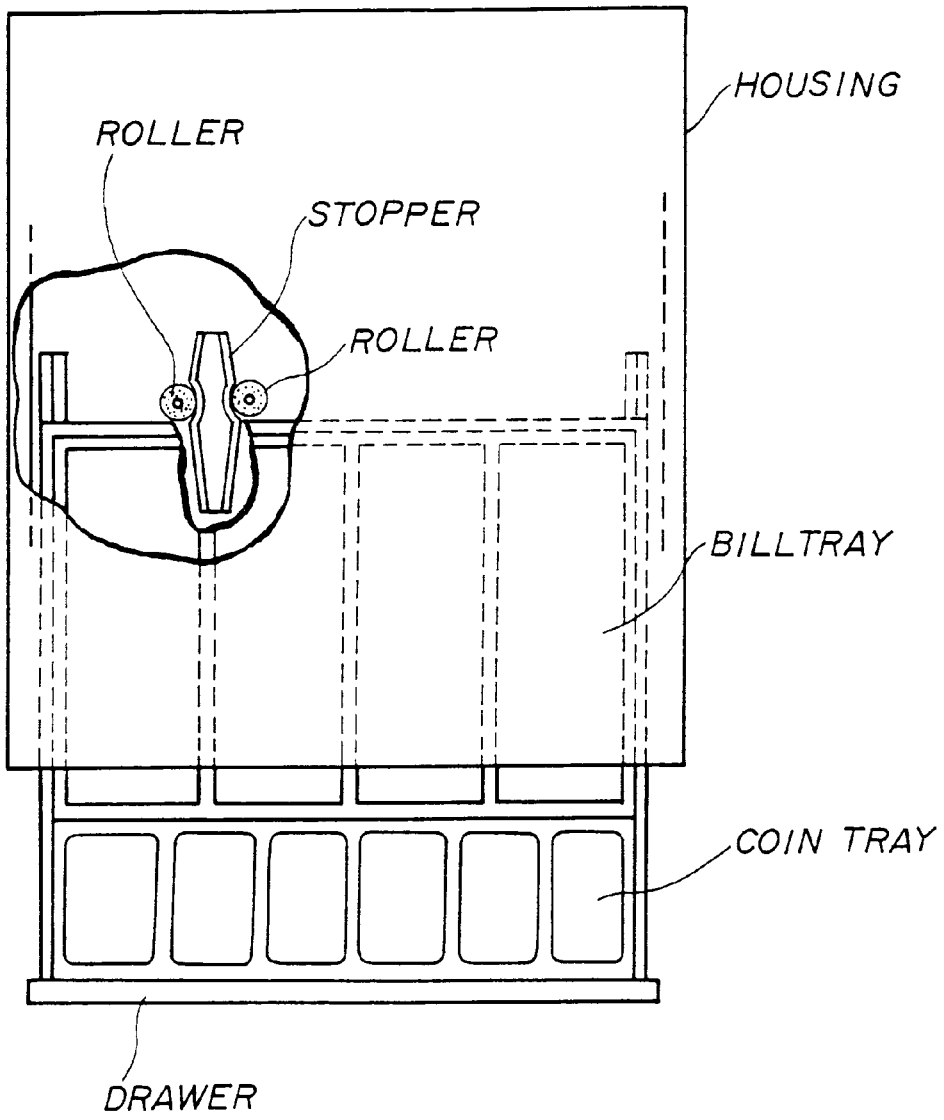
FIG. 7 is a diagram showing a position of the drawer which is stopped by the stopper positioned at the back of the housing as compared with the one shown in FIG. 4B.

FIG. 7 is a diagram showing a position of the drawer which is stopped by the stopper positioned further back of the housing as compared with the one shown in FIG. 4B. In the case shown in FIG. 7, since the stopper is located further back, as compared with the one shown in FIG. 4B, the drawer is stopped more towards the front and hence only a small portion of each of the bill trays is exposed to outside viewers. Thus, it becomes possible to prevent the bills contained in the trays from being seen by a third party.

Figure 8:
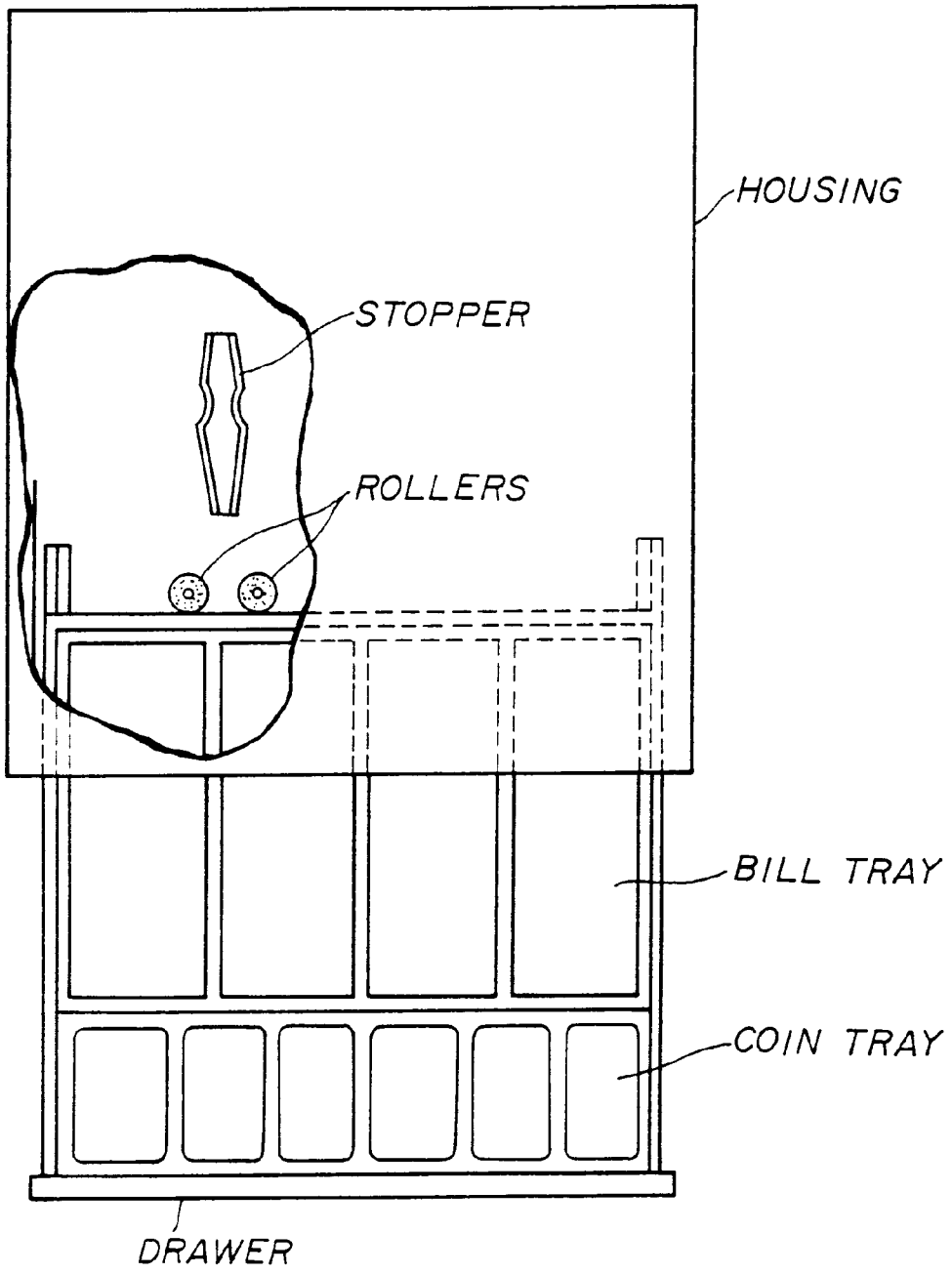
FIG. 8 is a diagram showing a position of the drawer which is pulled and further opened as compared with the one shown in FIG. 7.

As mentioned above, if the drawer is pulled by, for instance, an operator's hands, the drawer may be further opened as shown in FIG. 8. Thus, one can simply pull the drawer to satisfy his needs whenever it is necessary to handle the bills.

Moreover, according to the present invention, the stopper absorbs the opening force of the drawer and attenuates the opening velocity thereof. Thus, the possibility of an accident, for instance an operator being hit by the opening drawer, may be decreased as compared with a conventional drawer unit. In order to further decrease the possibility that the drawer may hit or contact the operator, the opening degree of the drawer may be further reduced. In practice, since the drawer may be fully opened by pulling the drawer by hand, it does not cause a significant problem if the opening degree of the drawer is initially small although it may depend on a particular situation of each store.

Figure 9:
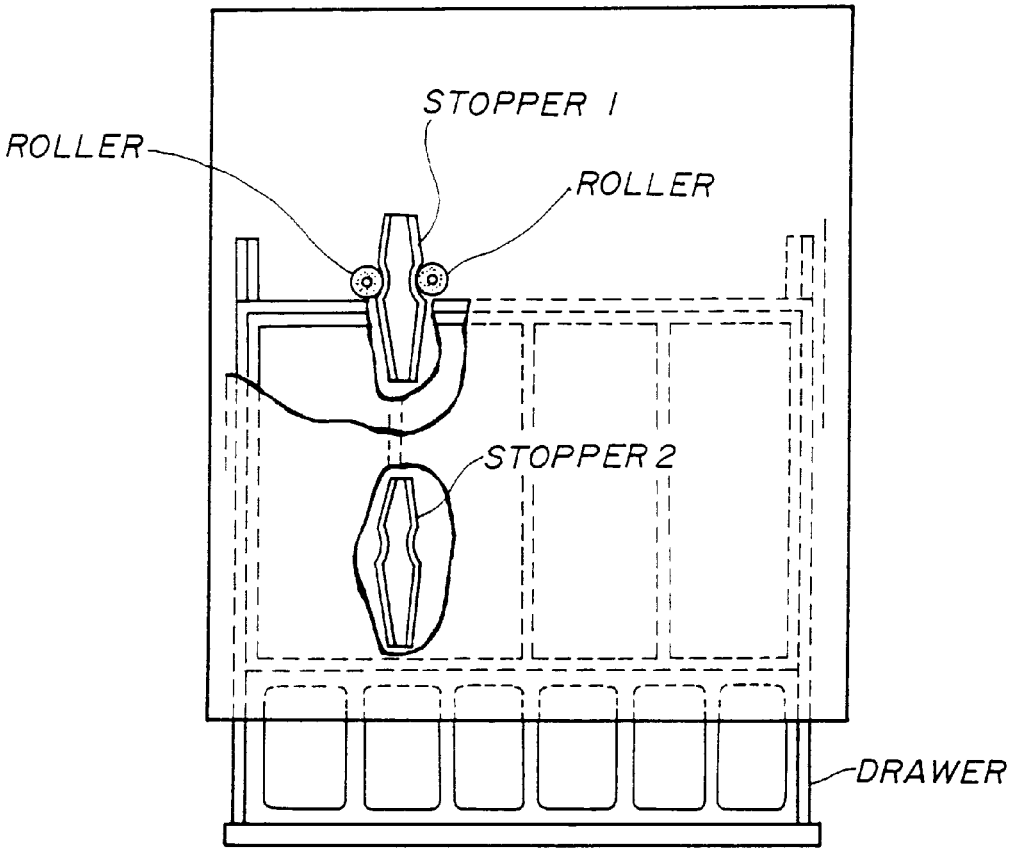
FIG. 9 is a diagram showing a drawer unit according to another embodiment of the present invention.
Figure 10:
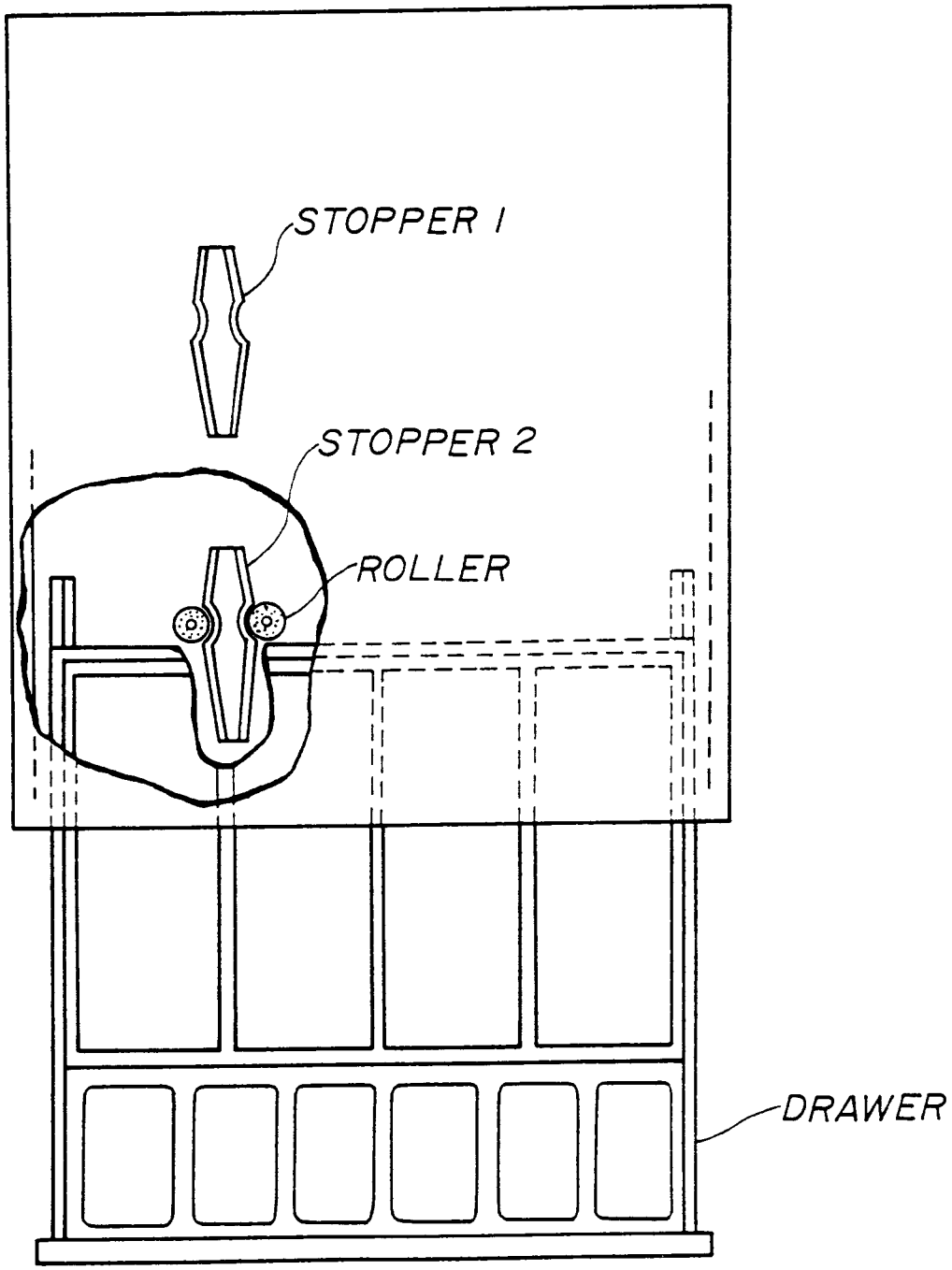
FIG. 10 is a diagram showing a drawer unit according to another embodiment of the present invention.

FIGS. 9 and 10 are diagrams showing a drawer unit according to another embodiment of the present invention. In the embodiment shown in FIGS. 9 and 10, a plurality of stoppers (two—the stopper 1 and the stopper 2—in the case shown in the figures) is provided so as to be aligned on the same axis. The function of the stopper 1 is, for instance, to attenuate the opening force of the drawer and the function of the stopper 2 is, for example, to prevent the bill trays from being fully exposed.

In FIG. 9, the drawer is stopped by the stopper 1 provided at the back and in FIG. 10, the drawer is stopped by the stopper 2 provided at the front. The state of the drawer shown in FIG. 9 substantially corresponds to the state shown in FIG. 7 and the state of the drawer shown in FIG. 10 substantially corresponds to the state shown in FIG. 4B. That is, the opening degree of the drawer is set to be small in the first step as shown in FIG. 9 and only the coin trays are exposed in this state. On the other hand, the opening degree of the drawer is set to be sufficiently large in the second step as shown in FIG. 10 and most portions of the bill trays are exposed in this state. Note that the drawer may be further opened from the state shown in FIG. 10 if it is pulled in the forward direction.

That is, if the drawer stopped by the stopper 1 is pulled in the forward direction, it may be opened to a position where the stopper 2 is located. The drawer stopped by the stopper 2 may be further opened and the trays fully exposed by pulling the drawer further in the forward direction.

According to the present invention, as explained above, since the opening degree of the drawer may be adjusted, it becomes possible to achieve a desired opening degree of the drawer in accordance with a condition of each store or shop. Also, the danger that the drawer may contact or hit an operator when it is opened can be eliminated. Moreover, it becomes possible to prevent bills in the drawer from being seen by a third party.

Further, since the drawer stopped by a stopper may be further opened, it is possible to use the stopper for attenuating the opening velocity of the drawer. In addition, a plurality of stoppers may be provided so as to be aligned on the same axis so that a multiple-level opening/closing operation of the drawer may be performed.

Note that the positional relationship between the rollers and the stopper is not limited to the cases mentioned above, and the rollers or a structure corresponds to the rollers may be provided with a housing. Likewise, the stopper or a structure corresponds to the stopper may be provided with a drawer.

Also, rollers, stoppers and any structure which correspond to the rollers and the stoppers may be employed as long as they possess functions corresponding to the functions of the rollers/stoppers explained above.

In addition, the present invention is not limited to the above embodiments, and variations and modifications may be made without departing from the scope of the present invention.

What is claimed is:

1. An opening/closing mechanism for a drawer member comprising:

a stopper means for stopping movement of said drawer member, wherein an attachment position of said stopper means in which said stopper means is fixedly attached to at least one of the drawer member and a housing member accommodating the drawer member is variable, in the direction of movement of said drawer member, so as to adjust a degree of opening of said drawer member.

2. The opening/closing mechanism as claimed in claim 1, wherein said stopper means enables a resumption of the movement of said drawer member after the movement has been stopped by said stopper means.

3. The opening/closing mechanism as claimed in claim 2, wherein a plurality of said stopper means are provided.

4. A drawer unit comprising:

a drawer member, and a stopper means for stopping movement of said drawer member, wherein an attachment position of said stopper means in which said stopper means is fixedly attached to the drawer member is variable, in the direction of movement of said drawer member, so as to adjust a degree of opening of said drawer member.

5. The drawer unit as claimed in claim 4, wherein said stopper means enables a resumption of the movement of said drawer member after the movement has been stopped by said stopper means.

6. The drawer unit as claimed in claim 5, wherein a plurality of said stopper means are provided.

7. An opening/closing mechanism for a drawer member which is accommodated in a housing member so as to be movable in back and forth directions comprising:

a first guiding member fixedly provided with one of said drawer member and said housing member, and a second guiding member fixedly provided with another one of said drawer and said housing member;

wherein said first guiding member contacts said second guiding member when said drawer member has moved a certain distance thereby stopping movement of said drawer member, and an attachment position of at least one of said first guiding member and said second guiding member to at least one of the drawer member and the housing member is variable, in the direction of movement of said drawer member, so as to adjust a position and degree of opening of said drawer member.

8. The opening/closing mechanism as claimed in claim 7, wherein each of said first guiding member and said second guiding member enables a resumption of the movement of said drawer member after the movement of said drawer member has been stopped by said first guiding member and said second guiding member.

9. The opening/closing mechanism as claimed in claim 8, wherein a plurality of one of said first guiding member and said second guiding member is provided.

10. A drawer unit comprising:

a housing;

a drawer movably positioned in said housing;

a pair of rotatable rollers attached to a back of said drawer;

a spring biasing said rollers together;

a stopper fixedly attached on said housing, engagable by said rollers for stopping movement of said drawer upon contact with said rollers;

the attachment position of said stopper on said housing being variable, in the direction of movement of the drawer, so as to adjust the degree of opening of said drawer.

11. The drawer unit as claimed in claim 10, wherein said stopper means enables a resumption of the movement of said drawer member after the movement has been stopped by said stopper means.

12. The drawer unit as claimed in claim 11, wherein a plurality of said stopper means are provided.

13. A drawer unit comprising a housing;

a drawer movably positioned in said housing;

at least one rotatable roller attached to a back of said drawer;

a spring biasing said roller;

a stopper fixedly attached on said housing, engagable by said roller for stopping movement of said drawer upon contact with said roller;

the attachment position of said stopper on said housing being variable, in the direction of movement of the drawer, so as to adjust the degree of opening of said drawer.

14. The drawer unit as claimed in claim 13.

wherein said stopper means enables a resumption of the movement of said drawer member after the movement has been stopped by said stopper means.

15. The drawer unit as claimed in claim 14, wherein a plurality of said stopper means are provided.

* * * * *